US008910557B2

(12) United States Patent
Cox et al.

(10) Patent No.: US 8,910,557 B2
(45) Date of Patent: Dec. 16, 2014

(54) PAYLOAD DEPLOYMENT SYSTEM AND METHOD

(71) Applicant: Raytheon Company, Waltham, MA (US)

(72) Inventors: Donald P Cox, Tucson, AZ (US); Robert W Knox, Oro Valley, AZ (US); Derek S Wall, Tucson, AZ (US); Michael D Stokes, Tucson, AZ (US); Darren C Smith, Tucson, AZ (US); Scott G Martin, Oro Valley, AZ (US); Michael J Holt, Oro Valley, AZ (US); Bradley M Gaul, Tucson, AZ (US)

(73) Assignee: Raython Company, Waltham, MA (US)

( * ) Notice: Subject to any disclaimer, the term of this patent is extended or adjusted under 35 U.S.C. 154(b) by 0 days.

(21) Appl. No.: 13/754,152

(22) Filed: Jan. 30, 2013

(65) Prior Publication Data

US 2014/0208927 A1 Jul. 31, 2014

(51) Int. Cl.
*F41F 7/00* (2006.01)
*F41F 3/04* (2006.01)

(52) U.S. Cl.
CPC ..... *F41F 7/00* (2013.01)
USPC ..... 89/1.51; 89/1.8

(58) Field of Classification Search
USPC ..... 89/1.51, 1.54, 1.55, 1.56, 1.6, 1.8, 89/1.806, 1.809, 1.81, 1.815, 1.816, 1.817, 89/1.819
See application file for complete search history.

(56) References Cited

U.S. PATENT DOCUMENTS 3,865,009 A * 2/1975 Kongelbeck ..... 89/1.815
3,988,961 A 11/1976 Banta et al.
4,302,666 A * 11/1981 Hawkins ..... 235/404
4,416,183 A * 11/1983 Adams et al. ..... 89/1.807
4,433,606 A 2/1984 Hagelberg et al.
4,444,087 A * 4/1984 Hunter et al. ..... 89/1.802
4,470,336 A * 9/1984 Swann et al. ..... 89/1.815
4,471,684 A * 9/1984 Johnson et al. ..... 89/1.815
4,498,368 A * 2/1985 Doane ..... 89/1.817
4,604,939 A * 8/1986 Hoffmeister et al. ..... 89/1.816
H213 H * 2/1987 Panlaqui ..... 89/1.8
5,058,481 A 10/1991 Drummond et al.
5,153,367 A * 10/1992 Markquart et al. ..... 89/1.816
5,758,845 A * 6/1998 Sunne et al. ..... 244/131
6,868,769 B1 * 3/2005 Wright ..... 89/1.811
7,070,434 B2 7/2006 Paul et al.
7,293,492 B2 * 11/2007 Brunn ..... 89/1.807
8,256,338 B1 * 9/2012 Kirchner et al. ..... 89/1.8
2003/0089220 A1 * 5/2003 Boudreau et al. ..... 89/1.815
2009/0240856 A1 * 9/2009 Lewis et al. ..... 710/105

* cited by examiner

*Primary Examiner* — Bret Hayes
(74) *Attorney, Agent, or Firm* — Renner, Otto, Boisselle & Sklar, LLP

(57) ABSTRACT

A payload deployment system includes a mount for receiving one or more payload modules that each include one or more payloads to be deployed. The payload modules also each include a sleeve, with the one or more payloads are in one or more openings in the sleeve. The payloads may be contained in respective containers, such as hermetically-sealed containers, that are in the openings. The electrical coupling may be wireless coupling, for transferring electrical power to the payload module(s), and for communication, such as networked communication, between the mount and the one or more payload modules. The wireless coupling may be inductive coupling that involves overlap of inductive elements such as wire coils. The payload deployment system may also include one or more translators for translating commands and/or other communications between the one or more payload modules and a platform to which the payload deployment system is coupled.

21 Claims, 7 Drawing Sheets

PAYLOAD DEPLOYMENT SYSTEM AND METHOD

BACKGROUND OF THE INVENTION

1. Field of the Invention

The invention is in the field of payload deployment systems and methods.

2. Description of the Related Art

There are a large variety of weapons, sensors, and sorts of deployable payloads that may be launched or otherwise deployed from systems. Such payloads often involve very different sorts of mechanical couplings and communication protocols. The payloads often require dedicated deployment systems, which limits ability to deploy payloads and flexibility in deployment of payloads.

SUMMARY OF THE INVENTION

A payload deployment system is able to handle a wide variety of payloads. The deployment system includes a mount that receives different types of payload assemblies that include different types of payloads. The payload assemblies may be swapped in and out of the mount to change the configuration of payloads that may be deployed, such as by being launched or otherwise employed. The payload deployment system may include wireless electrical connections, and/or one or more translators for translating commands or other types of communication between the payload assembly and a platform that supports the payload deployment system (or between parts of the chain between the platform and the one or more payloads).

According to an aspect of the invention, a payload deployment system includes: a mount for mounting the system to a platform; and a payload module that slidingly engages the mount to both mechanically and electrically couple the payload module to the mount.

According to another aspect of the invention, a payload deployment system includes a mount for mounting the system to a platform; and a payload module that is mechanically and electrically coupled to the mount. The mount includes a translator for translating communications between the platform and the payload module, passing through the mount.

According to yet another aspect of the invention, a method of payload deployment includes: engaging a payload module that contains one or more payloads, with a mount of a payload deployment system; providing power and communication to the payload, through the mount; and deploying the payload from the payload deployment system.

According to still another aspect of the system, a payload deployment system includes: a mount for mounting the system to a platform; and a payload module that electromechanically engages the mount to both mechanically and electrically couple the payload module to the mount; wherein the payload module includes a sleeve; and wherein the sleeve has one or more openings for receiving one or more payloads.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF THE DRAWINGS

The annexed drawings, which are not necessarily to scale, show various aspects of the invention.

DETAILED DESCRIPTION

A payload deployment system includes a mount for receiving one or more payload modules that each include one or more payloads to be deployed. The payload modules also each include a sleeve, with the one or more payloads are in one or more openings in the sleeve. The payloads may be contained in respective containers, such as hermetically-sealed containers, that are in the openings. The one or more payload modules may slide into one or more mount openings in the mount, to mechanically and electrically couple the payload module(s) and the mount. The electrical coupling may be wireless coupling, for transferring electrical power to the payload module(s), and for communication between the mount and the one or more payload modules. The wireless coupling may be magnetic inductive coupling that involves overlap of inductive elements such as wire coils. The payload deployment system may also include one or more translators for translating commands and/or other communications between the one or more payload modules and a platform to which the payload deployment system is coupled. The payload deployment system provides increased flexibility in being able to accommodate a variety of payloads, and switch them quickly.

Figure 1:
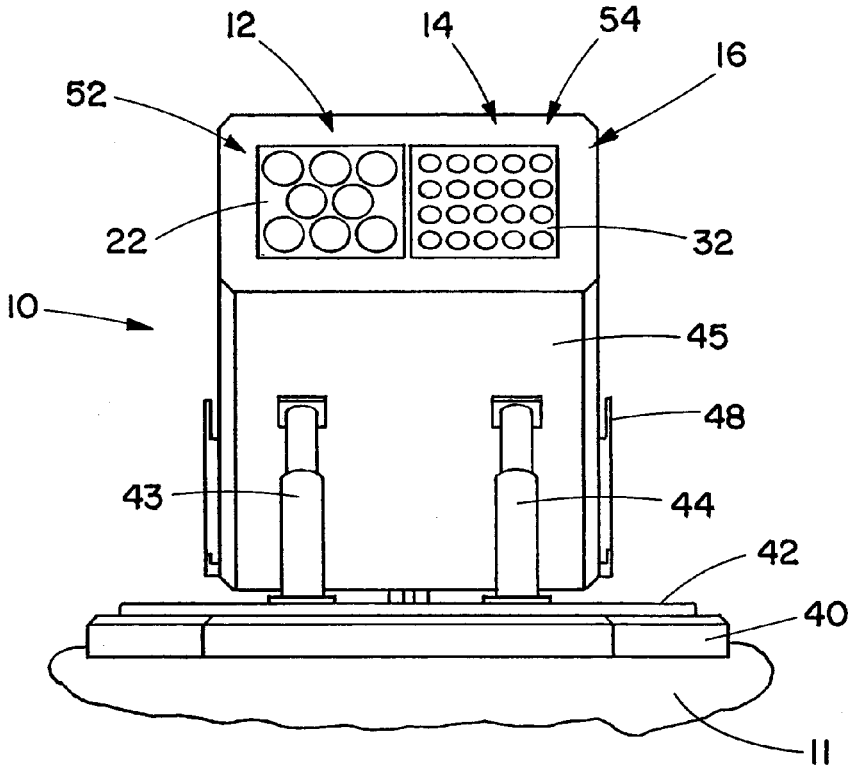
FIG. 1 is a frontal view of a payload deployment system in accordance with an embodiment of the present invention.
Figure 2:
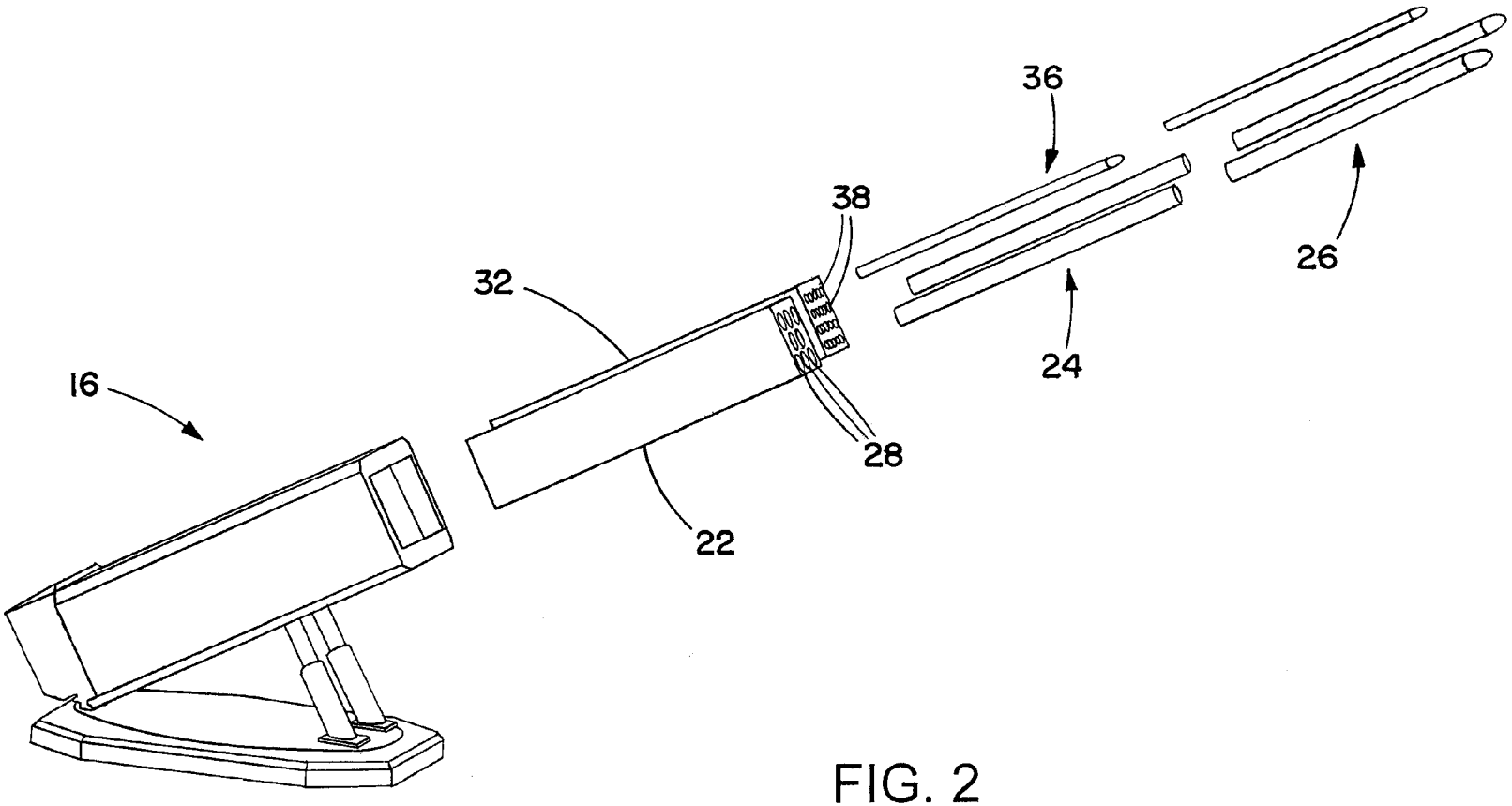
FIG. 2 is an exploded view of the payload deployment system of FIG. 1.

FIGS. 1 and 2 show a payload deployment system 10 that is mounted on a platform 11, and is used to deploy payloads from any of a variety of payload modules, such as payload modules 12 and 14 in the illustrated embodiment. "Deploy" is used herein as a broad term for putting a payload into operation. Deploying may involve launching a payload, such as a weapon, from the deployment system 10. Deploying may alternatively involve physically separating another payload, such as a sensor, from the system 10. As another alternative, deploying may involve putting a payload, such as a sensor, into operation, without physically separating the payload from the system 10.

The payload modules 12 and 14 are loaded into a mount 16 of the system 10, and each of the payload modules 12 and 14 has multiple parts. The payload module 12 has a sleeve 22, payload containers 24 that fit into sleeve openings 28 in the sleeve 22, and payloads 26 that are within the payload containers 24. The payloads 26 may be in respective of the payload containers 24. The payload module 14 has a sleeve 32, with payloads 36 placed directly into sleeve openings 38 in the sleeve 32, without any intermediate containers. In the illustrated embodiment the payloads 26 and 36 are missiles, although many other types of payloads may be used instead.

The containers 24 may be hermetically sealed containers that act as an interface between the sleeve 22 and the payloads 26. The containers 24 may be "smart" containers, which mat employ an embedded computer and/or other electromechanical devices, each able to accept a variety of payloads, that can adapt deployment commands and/or other communication to and from the payloads, to enable the same sleeve 22 to accommodate a variety of different payloads. This facilitates the system 10 being able to accommodating a variety of different payloads.

The containers 24 may be disposable, one-time-use containers. They may be made of a material, such as a low-cost composite and/or foam material, that may be damaged and/or destroyed when the payloads 26 are deployed, such as when a missile payload is launched. Such a deployment may also damage or destroy any electronics in the containers 24.

The payload system 10 provides mechanical and electrical coupling from the platform 11, all the way to the payloads 26 and 36. The platform 11 is mechanically and electrically coupled to the mount 16, which in turn is electrically and mechanically coupled to the sleeves 22 and 32. The sleeve 22 may be electrically and mechanically coupled to the payloads 26, either directly or by electrical and/or mechanical coupling through the payload containers 24. The sleeve 32 is also electrically and mechanically coupled to the payloads 36.

Figure 3:
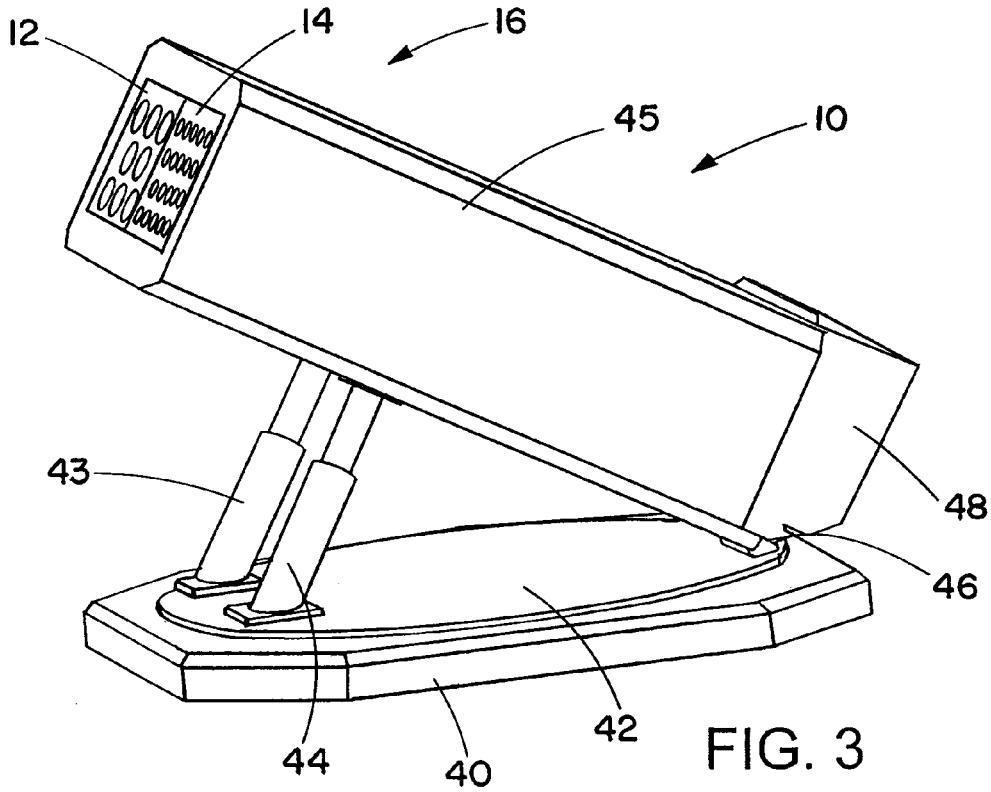
FIG. 3 is an oblique view of the payload deployment system of FIG. 1.

The mechanical coupling of the various parts may be accomplished by any of a variety of mechanisms. The mount 16 may be fixedly attached to the platform 11, for example with a base 40 of the mount 16 being bolted to the platform 11. A pedestal 42 of the mount 16 may be movable relative to the base 40. The pedestal 42 may be able to pivot to change elevation, and may be able to rotate relative to the base 40 to change azimuth. With reference in addition to FIG. 3, the mount 16 includes a pair of elevation struts 43 and 44 which may be adjusted to change the angle of the payload assemblies 12 and 14 in the mount 16, with the portion 45 of the mount 16 that houses the payload assemblies 12 and 14 being hinged at a back end 46. The mount 16 may also be able to turn about its vertical axis (or an axis of the system) to allow further options in orienting the payload assemblies 12 and 14 for deployment of the payloads. The payloads in the payload assemblies 12 and 14 are protected from environmental conditions by being loaded in the sleeves 22 and 32. The mount 16 may also include an exhaust gas management device 48 that is used for diverting and/or dispersing exhaust gases produced in operation of the system 10, such as in launching of a munition.

The electrical connection between the mount 16 and the platform 11 may be any of a variety of hard-wired or wireless connections, for example using convention electrical connectors. The electrical connection may provide electrical power to the system 10, as well as providing transferring information such as commands and data.

The payload modules 12 and 14 slide into appropriately-shaped openings 52 and 54 in the mount 16. The payload modules 12 and 14 may automatically mechanically couple to the mount 16 when they fully slide into the openings to engage a locking mechanism at the end of the mount 16. The locking mechanism may include spring pins that engage recesses in the sleeves 22 and 32, or any of a variety of other suitable securement mechanisms.

Figure 4:
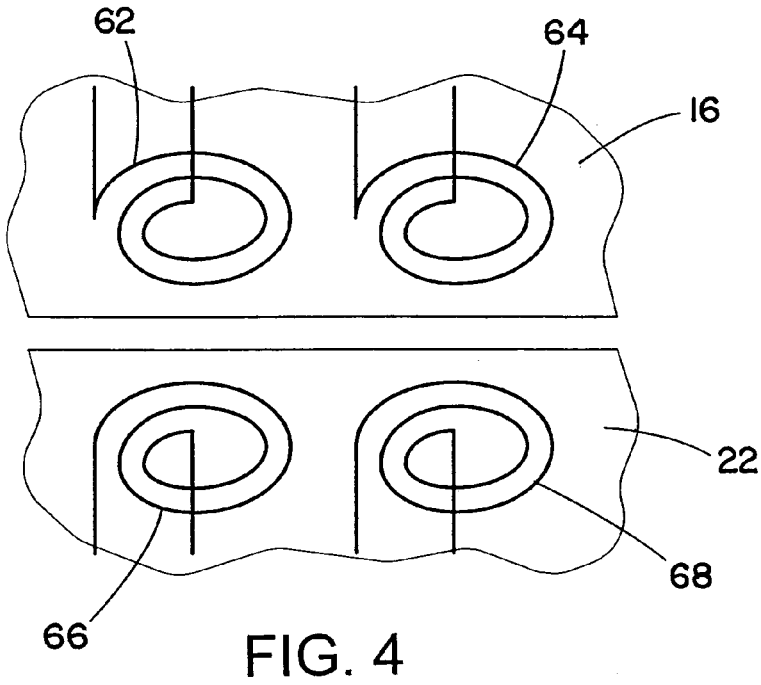
FIG. 4 is a schematic view showing one embodiment of an electrical coupling between a sleeve and the mount of the payload deployment system of FIG. 1.

Sliding the payload modules 12 and 14 into the openings 52 and 54 also enables an electrical connection between the mount 16 and the sleeves 22 and 32. The electrical connection may be a non-contact inductive coupling, such as is illustrated in FIG. 4 for the connection between the mount 16 and the sleeve 22. In the illustrated embodiment, the mount 16 includes a pair of coils 62 and 64, and the sleeve 22 includes a pair of coils 66 and 68. The sleeve coils 66 and 68 are located on the sleeve 22 so as to line up with the mount coils 62 and 64 when the payload module 12 is loaded into the opening 52 (FIG. 1). Thus, when the payload module 12 is installed in the mount 16, the sleeve coil 66 at least partially overlaps the mount coil 62, and the sleeve coil 68 at least partially overlaps the mount coil 64. The coils 62 and 66 are power transfer coils used to transfer power from the mount 12 to the sleeve 22. The coils 64 and 68 are communication coils that are use to allow communication between the mount 16 and the sleeve 22. The communication may include transferring commands from the mount 16 to the sleeve 22, and transferring data from the sleeve 22 to the mount 16, to give just two examples.

Alternatively the electrical connection may include only a single pair of coils, used to transfer both power and communications. Communications signals can be overlaid on power generation wavefronts. In addition, the coils 62-68 may have any of a wide variety of suitable shapes. The coils 62-68 are examples of one type of inductive coupler for coupling together the mount 16 and the sleeve 22.

Other types of electrical connections may be used for providing some or all of the electrical connection between the mount 16 and the sleeve 22. For example, electrically conductive pads on the mount 16 and the sleeve 22 may make contact when the payload module 12 is installed in the opening 52 (FIG. 1), to make the connection for transferring power and/or for allowing communication. As another example, communication may be accomplished in whole or in part by use of by transmission and receipt of signals utilizing a wide variety of electromagnetic frequencies, such as audio or radio frequencies.

The coils 62-68 may be placed on side surfaces of the mount 16 and the sleeves 22 and 32, such as the interior surfaces of the mount 16 and the exterior surfaces of the sleeves 22 and 32. Alternatively, the coils 62-68 may be located on an interior rear surface of the mount 16, and on exterior rear surfaces of the sleeves 22 and 32.

As another alternative, a coaxial arrangement may be used. The coils 62-68 may be around perimeters of the sleeves 22 and 32, and around a perimeter of the interior surface of the mount 16, such that the coils 62-68 are in proximity when the sleeves 22 and 32 are loaded into the mount 16.

The various electrical connection methods described above may also be used for electrical connection between the other parts of the system 10. Any or all of the above methods may be used for electrical connection between the mount 16 and the sleeve 32, between the sleeve 22 and the containers 24 and/or the payloads 26, between the sleeve 22 and the payloads 26, and/or between the sleeve 32 and payloads 36. The various parts may have single or double pairs of aligned coils for inductive transfer of power and/or communication signals, similar to the arrangement shown in FIG. 4. Alternatively, as in the illustrated embodiment, there may be a wired interface between the containers 24 and their corresponding payloads 26, for example employing suitable electrical connectors.

The platform 11 may be any of a variety of platforms for weapons or other payloads. The platform 11 may be a vehicle, such as a land vehicle (e.g., an armored personnel carrier) or a sea vehicle (e.g., a ship). Alternatively, the platform 11 may be at a temporarily or permanently at a fixed location, such as at building, or at a facility where offensive and/or defensive weapons are employed, or where sensors or other payloads are to be deployed.

Figure 5:
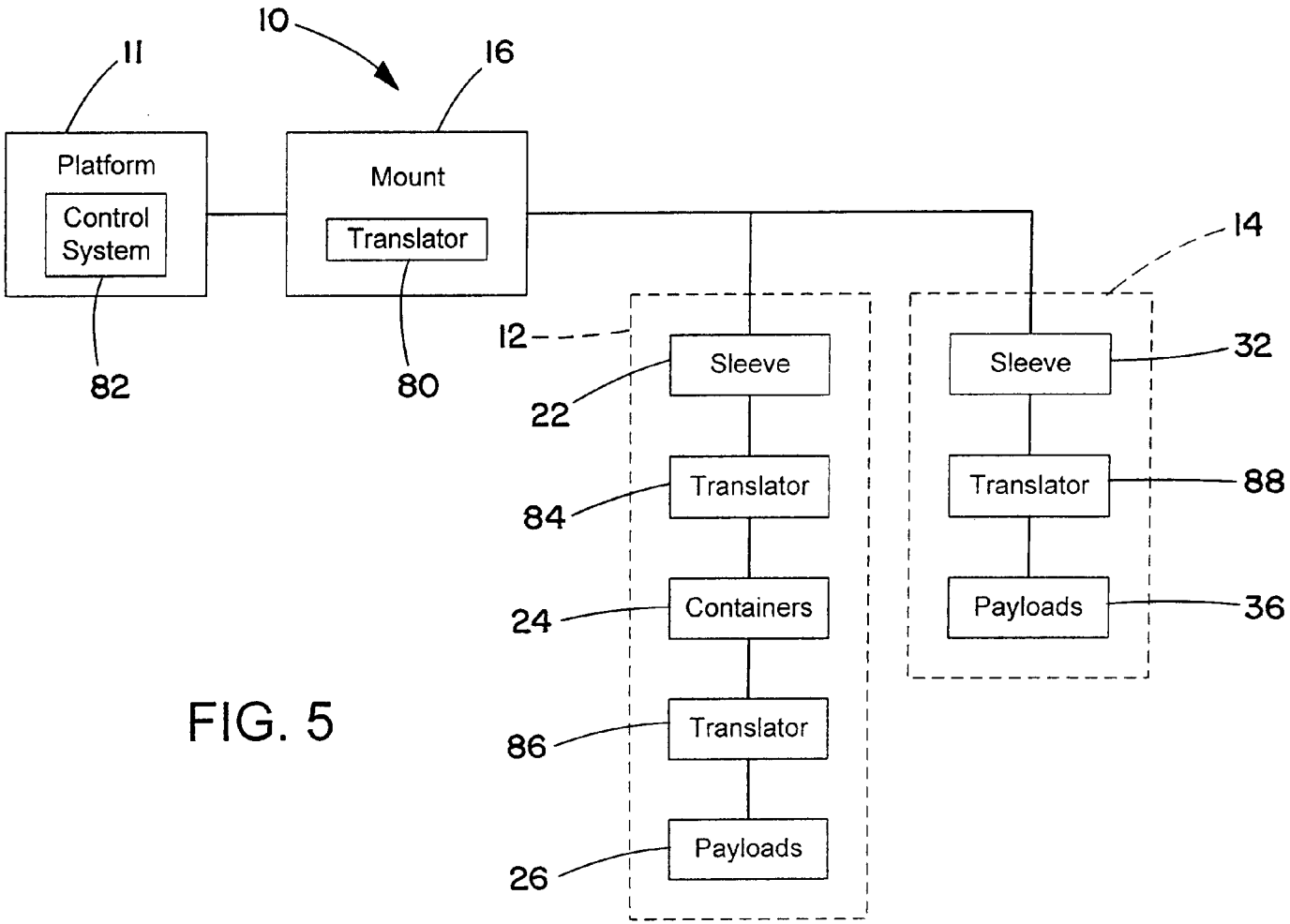
FIG. 5 is a block diagram showing connections between elements of the payload deployment system of FIG. 1.

Referring now in addition to FIG. 5, the mount 16 may include a translator 80 for translating communications that pass through the mount 16 between the platform 11 and the payload modules 12 and 14. The translator 80 may translate commands or other information received from the platform 11, such as from a control system 82 of the platform 11, into a form that is suitable for use by the payload modules 12 and 14. The control system 82 may be a fire control system that sends commands, for example to fire or launch a munition payload or other launchable payload device. The fire control system may also send other information, such as targeting information. Alternatively the control system 82 may be sensor control system for controlling or sending information to an information-gathering payload.

The translator 80 may also translate data or other communications, such as status indications, sent by the payloads 26 and 36, bound for the platform 11, for example being sent to the control system 82. The communications from the payloads 26 and 36 may be sent to the mount 16 directly by the payloads 26 and 36, or may passed through intermediate stages, such as though the sleeves 22 and 32, and/or through the containers 24.

The translator 80 may be embodied in a processor or integrated circuit, as hardware and/or software. The translator 80 may use a look-up table to translate between the platform 11 and the payload modules 12 and 14. Alternatively the translator 80 may use parsing/interpretation translations methods or symbolic pattern matching (such as to derive or determine equivalent commands between different communication protocols), or may use other methods of translation. In addition the translator 80 may use suitable encryption and/or decryption methods in communication, particularly when wireless communication is involved. Such wireless communication may involve any of a variety of suitable wireless communication protocols for communicating between multiple items.

The translator 80 may be programmed or otherwise set to account for the protocols it is translating between, those used by the platform 11 and the payload modules 12 and 14. Alternatively, the translator 80 may be configured to automatically recognize some or all communication protocols, and translate accordingly.

There may be similar translators at other connections in the system 10. For example, there may be a translator or translators 84 in the sleeve 22 or in the containers 24, translating between the sleeve 22 and the containers 24. Alternatively or in addition there may be translators 86 in the containers 24, translating between the containers 24 and their payloads 26. Further, there may be a translator or translators 88 in the sleeve 32, translating between the sleeve 32 and the payloads 36. The translators 84 and 88 in the sleeves 22 and 32 may be configured to handle translation to and/or from both containers and payloads. Some or all of the translators 80, 84, 86, and 88 may be omitted if desired, as circumstances permit.

The translators of the payload system 10 (the mount 11 and various components of the payload modules 12 and 14) may be connected in a communication network configuration. The network configuration enables intercommunication between the fire control system and the various components of the payload system 10. These communications may include built-in testing, functional capability reporting, launch initiation, providing a communication path for a sensor data, and/or payload identification. Suitable network technologies, for example as in a local Ethernet network, may be used for the communication network configuration.

The system 10 provides for flexibility in deploying payloads, allowing different types of payload modules to be swapped in and out of the mount 16. Different types of payload modules may be mixed and matched in the mount 16, with the mix of deployable payloads changeable for different locations, environments, missions, and/or other circumstances. The changing of payload modules to enable deployment of different payloads may be accomplished by unloading one or more of the payload modules 12 and 14, and replacing them with different payload modules. The simple mechanical coupling and wireless electrical coupling between the system 16 and the payload modules 12 and 14 may facilitate the swapping out processes. The translators 80, 84, 86, and/or 88 may allow for the system to account for any changes in communication protocols occasioned by the change in payload modules. The swapping out process is convenient enough to allow for regular changes in payloads, for example to configure the system 10 differently at different times of day, on a regular basis.

The payloads 26 and 36 may include any of a wide variety of devices. Examples of payloads include missiles of various types (e.g., anti-aircraft missiles or surface-to-surface missiles), unmanned aerial vehicles (UAVs), sensors, sonobuoys, torpedoes, chaff-deploying devices, flares, decoys, and other deployable objects, such as air-drop mines, depth charges, or directed energy weapons.

Figure 6:
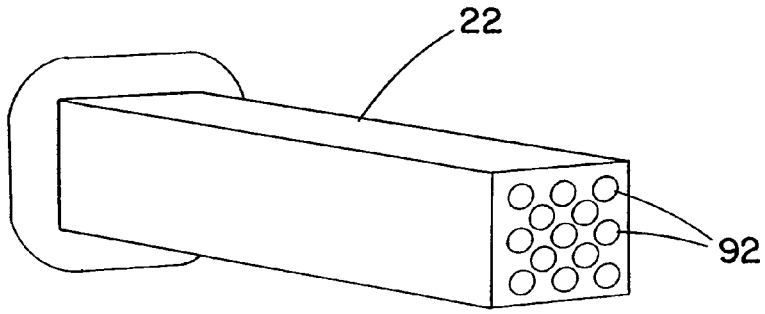
FIG. 6 is an oblique view of one sleeve usable with the payload deployment systems of FIG. 1.
Figure 7:
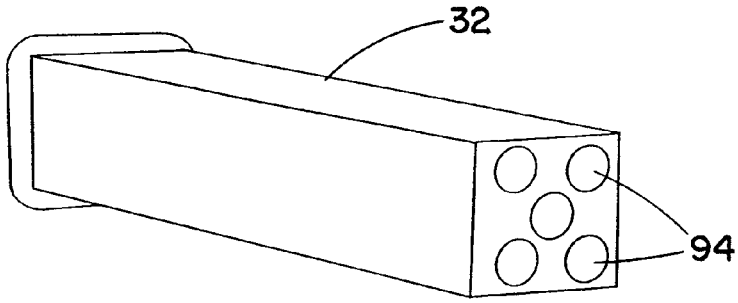
FIG. 7 is an oblique view of another sleeve usable with the payload deployment systems of FIG. 1.
Figure 8:
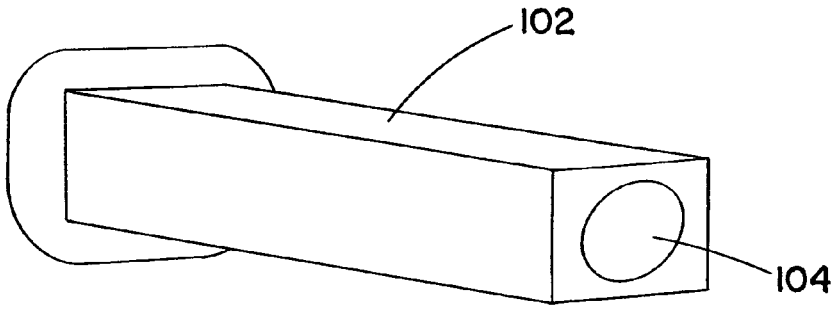
FIG. 8 is an oblique view of yet another sleeve usable with the payload deployment systems of FIG. 1.

FIGS. 6-8 show examples of different types of sleeves. The sleeve 22 (FIG. 6) has thirteen sleeve openings 92, each having a diameter of 7.6 cm (3 inches). The sleeve 32 (FIG. 7) has five sleeve openings 94, each having a diameter of 16.5 cm (6.5 inches). Another sleeve 102 (FIG. 8) has a single sleeve opening 104, with a diameter of 51 cm (20 inches). Many other configurations are possible, including configurations which have multiple sizes of openings in a single sleeve.

Figure 9:
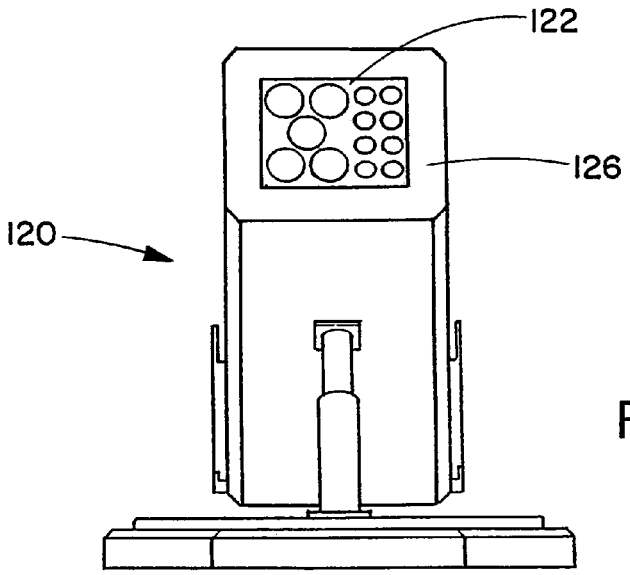
FIG. 9 is a frontal view of a payload deployment system in accordance with an alternate embodiment of the present invention.
Figure 10:
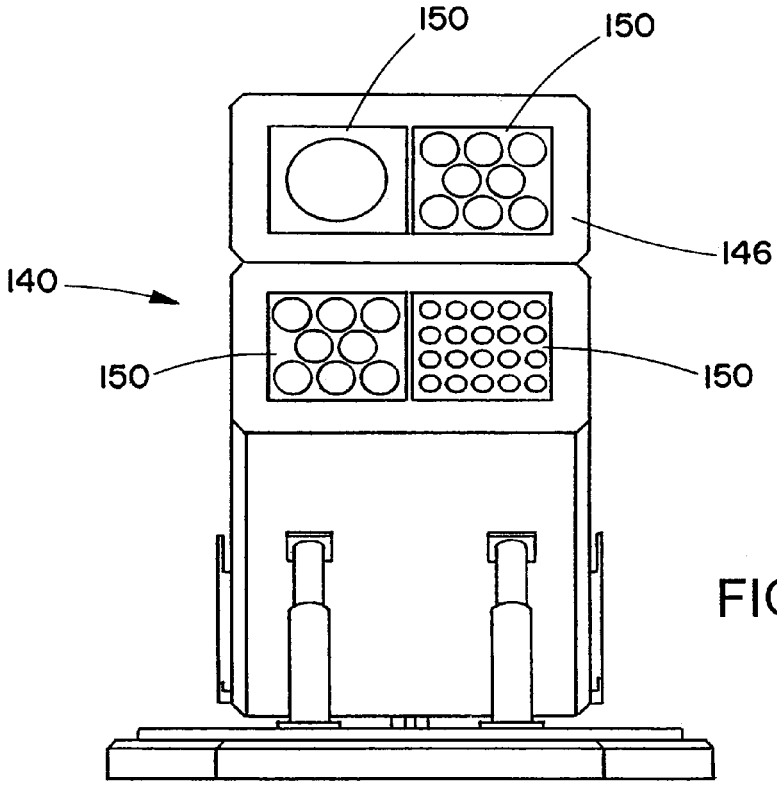
FIG. 10 is a frontal view of a payload deployment system in accordance with another alternate embodiment of the present invention.
Figure 11:
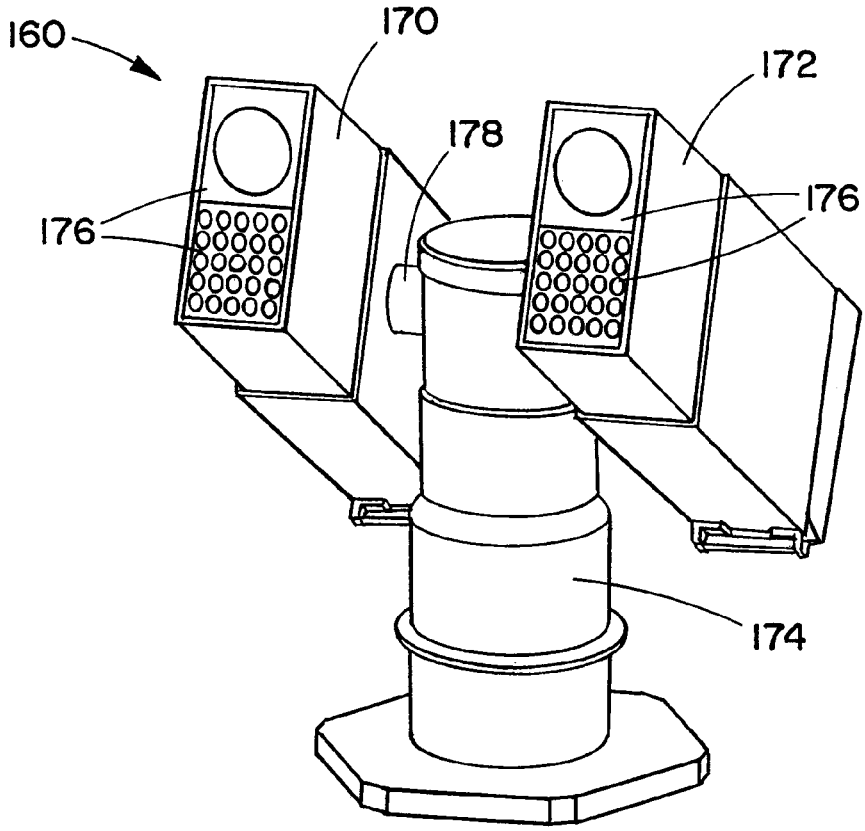
FIG. 11 is an oblique view of a payload deployment system in accordance with yet another alternate embodiment of the present invention.

FIGS. 9-11 shows examples of various alternate system configurations. FIG. 9 shows a smaller system 120 which receives a single payload assembly 122 in its mount 126. Other aspects of the system 120 may be similar to those of the system 10 (FIG. 1).

FIG. 10 shows one embodiment of a larger system 140 that has a mount 146 that is able to receive four payload assemblies 150. Other aspects of the system 140 may be similar to those of the system 10 (FIG. 1).

FIG. 11 shows another embodiment larger system, a payload deployment system 160. In the system 160 a mount 166 includes a pair of pods 170 and 172 coupled to opposite sides of a central structure 174, which is a post in the illustrated embodiment. In the illustrated embodiment the pods 170 and 172 are each able to receive a pair of payload modules 176. The pods 170 and 172 may be coupled to a shaft 178 (or a pair of shafts) that allow the angle of the pods 170 and 172 relative to the post 174 to be changed, either together or separately. The combination of the central structure 174 and the pods 170 and 172 may be able to rotate, for instance about an axis of the central structure post 174.

Alternatives to the sliding engagements described above are possible. Such alternatives include various sorts of clipping or mechanical coupling operations to engage sleeves with mounts.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A payload deployment system comprising:

a mount for mounting the system to a platform; and a payload module that electromechanically engages the mount to both mechanically and electrically couple the payload module to the mount;

wherein the payload module includes a sleeve;

wherein the sleeve has at least one opening for receiving at least one payload; and wherein the mount, the sleeve, and at least one payload in the sleeve, are all connected through a communication network.

2. The payload deployment system of claim 1, wherein the payload module slidingly engages the mount.

3. The payload deployment system of claim 1, wherein the at least one payload is at least one container that is in the at least one opening.

4. The payload deployment system of claim 1, wherein the at least one payload includes at least one missile, at least one unmanned aerial vehicles (UAVs), at least one sensor, at least one sonobuoy, at least one torpedo, at least one chaff-deploying device, at least one flare, at least one decoy, or at least one deployable object.

5. The payload deployment system of claim 1, wherein the payload module is wirelessly electrically coupled to the mount.

6. The payload deployment system of claim 5, wherein the payload module is wirelessly electrically coupled to the mount by inductive coupling, with at least one inductive coupler on the payload module overlapping at least one inductive coupler on the mount.

7. The payload deployment system of claim 6, wherein the wireless electrical coupling transfers both electrical power and communication between the payload module and the mount.

8. The payload deployment system of claim 1, further comprising a second payload module that also electromechanically engages the mount.

9. The payload deployment system of claim 1, wherein the mount includes a translator for translating communications through the mount between the platform and the payload module, and wherein a communication received by the translator is translated into an equivalent communication output by the translator.

10. The payload deployment system of claim 1, wherein the mount is a rotating and elevating mount.

11. A payload deployment system comprising:

a mount for mounting the system to a platform; and a payload module that is mechanically and electrically coupled to the mount;

wherein the mount includes a translator for translating communications through the mount, between the platform and the payload module, and wherein a communication received by the translator is translated into an equivalent communication output by the translator;

wherein the payload module is wirelessly electrically coupled to the mount; and wherein the translator is configured to use a look-up table, parsing translations, and/or symbolic pattern matching to determine corresponding commands between different communication protocols of the platform and the payload module.

12. The payload deployment system of claim 11, wherein the payload module includes:

a sleeve; and at least one payload in at least one opening in the sleeve.

13. The payload deployment system of claim 12, wherein the at least one payload is at least one container that is in the at least one opening.

14. The payload deployment system of claim 13, wherein the at least one container is hermetically sealed.

15. The payload deployment system of claim 12, further comprising an additional translator for translating communications between the sleeve and the at least one payload.

16. The payload deployment system of claim 11, wherein the at least one payload includes at least one missile, at least one unmanned aerial vehicles (UAVs), at least one sensor, at least one sonobuoy, at least one torpedo, at least one chaff-deploying device, at least one flare, at least one decoy, or at least one deployable object.

17. The payload deployment system of claim 11, wherein the payload module is wirelessly electrically coupled to the mount by inductive coupling, with at least one inductive coupler on the payload module overlapping at least one inductive coupler on the mount.

18. The payload deployment system of claim 11, wherein the wireless electrical coupling transfers both electrical power and communication between the payload module and the mount.

19. The payload deployment system of claim 11, wherein the mount is a rotating and elevating mount.

20. A method of payload deployment, the method comprising:

engaging a payload module that contains at least one payload, with a mount of a payload deployment system;

providing power and communication to the at least one payload, through the mount, and through a sleeve of the payload module that receives the at least one payload, wherein the mount, the sleeve, and the at least one payload in the sleeve, are all connected through a communication network; and deploying the at least one payload from the payload deployment system.

21. The method of claim 20, wherein the providing the power and communication include providing the power and communication through a wireless connection between the mount and the payload module.

* * * * *